US009156183B2

(12) United States Patent
Andersson et al.

(10) Patent No.: US 9,156,183 B2
(45) **Date of Patent: *Oct. 13, 2015**

(54) CHAINSAW ARRANGEMENT

(75) Inventors: Mats Andersson, Huskvarna (SE); Rikard Rydberg, Norrahammar (SE); Stefan Stark, Huskvarna (SE)

(73) Assignee: HUSQVARNA AB, Huskvarna (SE)

( * ) Notice: Subject to any disclaimer, the term of this patent is extended or adjusted under 35 U.S.C. 154(b) by 86 days.

This patent is subject to a terminal disclaimer.

(21) Appl. No.: 13/291,494

(22) Filed: Nov. 8, 2011

(65) Prior Publication Data

US 2012/0102766 A1 May 3, 2012

Related U.S. Application Data

(63) Continuation of application No. PCT/SE2009/050518, filed on May 11, 2009.

(51) Int. Cl.
*B27B 17/00* (2006.01)

(52) U.S. Cl.
CPC ..... *B27B 17/0008* (2013.01); *B27B 17/00* (2013.01)

(58) Field of Classification Search
CPC .... B27B 17/00; B27B 17/0008; B27B 17/02; B27B 17/0033
USPC ..... 30/381–387; D8/65
See application file for complete search history.

(56) References Cited

U.S. PATENT DOCUMENTS 4,059,895 A * 11/1977 Hirschkoff ..... 30/382
D268,089 S * 3/1983 Sato ..... D8/65
4,680,862 A * 7/1987 Wieland et al. ..... 30/381
4,716,654 A * 1/1988 Wallmark ..... 30/383
4,727,651 A * 3/1988 Nakajima ..... 30/383
4,782,593 A * 11/1988 Kieser et al. ..... 30/382
4,785,539 A * 11/1988 Nagashima ..... 30/381
4,793,064 A * 12/1988 Nagashima ..... 30/382

(Continued)

FOREIGN PATENT DOCUMENTS

CN 1553847 A 12/2004
CN 1626302 A 6/2005

(Continued)

OTHER PUBLICATIONS

International Search Report and Written Opinion of PCT/SE2009/050518 filed May 11, 2009.

(Continued)

*Primary Examiner* — Jason Daniel Prone
(74) *Attorney, Agent, or Firm* — Nelson Mullins Riley & Scarborough LLP

(57) ABSTRACT

A chainsaw may include a guide bar, a cutting chain and a driving unit arranged to drive the cutting chain around the guide bar. The guide bar defines a first longitudinal axis extending along a center of the guide bar. The chainsaw further comprising a handle section for carrying and operating the chainsaw, wherein the handle section includes a control portion disposed on the upper side of the chainsaw. The control portion in turn includes a throttle lever for controlling the speed of the driving unit and the control portion has a left and a right side. The control portion defines a second longitudinal axis substantially extending along an upper side of at least a part of the control portion. An angle, A, between the first and the second longitudinal axes is between 14° and 45°.

14 Claims, 6 Drawing Sheets

(56) References Cited

U.S. PATENT DOCUMENTS

| | | | | | |
|---|---|---|---|---|---|
| D303,207 | S | * | 9/1989 | Nakajima | D8/65 |
| 4,912,848 | A | * | 4/1990 | Bidanset | 30/383 |
| 4,964,217 | A | * | 10/1990 | Siede et al. | 30/383 |
| 5,018,492 | A | | 5/1991 | Wolf et al. | |
| 5,233,750 | A | * | 8/1993 | Wolf et al. | 30/382 |
| 5,233,945 | A | * | 8/1993 | Wolf et al. | 30/381 |
| 5,272,813 | A | * | 12/1993 | Wolf et al. | 30/381 |
| 5,445,479 | A | * | 8/1995 | Hillinger | 30/296.1 |
| 5,570,512 | A | | 11/1996 | Hoppner | |
| D377,441 | S | * | 1/1997 | Hoppner et al. | D8/65 |
| 5,829,099 | A | * | 11/1998 | Kopelman et al. | 16/430 |
| 5,960,549 | A | * | 10/1999 | Hoppner | 30/381 |
| 6,575,285 | B2 | * | 6/2003 | Jong | 30/381 |
| 7,168,132 | B2 | | 1/2007 | Durr | |
| 7,287,331 | B2 | * | 10/2007 | Sasaki et al. | 30/382 |
| D560,456 | S | * | 1/2008 | Gieske et al. | D8/65 |
| D573,860 | S | * | 7/2008 | Shimokawa et al. | D8/65 |
| D575,605 | S | * | 8/2008 | Yamamoto et al. | D8/65 |
| 8,490,289 | B2 | * | 7/2013 | Nystrom et al. | 30/381 |
| 8,661,694 | B2 | * | 3/2014 | Bijsterveldt et al. | 30/381 |
| 8,707,568 | B2 | * | 4/2014 | Osawa et al. | 30/381 |
| 8,832,947 | B2 | * | 9/2014 | Osawa et al. | 30/381 |
| 2001/0010123 | A1 | | 8/2001 | Taomo et al. | |
| 2002/0129502 | A1 | * | 9/2002 | Durr et al. | 30/381 |
| 2009/0100688 | A1 | * | 4/2009 | Sugishita | 30/381 |
| 2011/0265334 | A1 | * | 11/2011 | Van Bijsterveldt et al. | 30/382 |
| 2012/0055034 | A1 | * | 3/2012 | Andersson et al. | 30/383 |
| 2012/0102765 | A1 | * | 5/2012 | Andersson et al. | 30/383 |
| 2012/0102766 | A1 | | 5/2012 | Andersson | |
| 2012/0324743 | A1 | * | 12/2012 | Bergquist et al. | 30/381 |

FOREIGN PATENT DOCUMENTS

| | | | | |
|---|---|---|---|---|
| CN | 1676255 | A | | 10/2005 |
| CN | 1715004 | A | | 1/2006 |
| CN | 2820404 | Y | | 9/2006 |
| DE | 2003918 | A1 | | 8/1971 |
| DE | 202004000140 | U1 | | 5/2005 |
| DE | 202005015199 | U1 | | 12/2005 |
| DE | 102010007193 | A1 | * | 12/2010 |
| EP | 1184137 | A2 | | 3/2002 |
| EP | 1541294 | A1 | | 6/2005 |
| EP | 1541305 | | | 6/2005 |
| EP | 1614513 | A1 | | 1/2006 |
| EP | 2422945 | A1 | * | 2/2012 |
| EP | 2433767 | A1 | * | 3/2012 |
| FR | 2629749 | A1 | * | 10/1989 |
| JP | H03153301 | A | | 7/1991 |
| JP | H06032321 | Y | | 2/1994 |
| JP | H1131501 | A | | 2/1999 |
| JP | 3029622 | B2 | * | 4/2000 |
| JP | 03167318 | B2 | | 3/2001 |
| JP | 2001205602 | A | | 7/2001 |
| JP | 2001310273 | A | | 11/2001 |
| JP | 2002048164 | A | | 2/2002 |
| JP | 2003117902 | A | | 4/2003 |
| JP | 2006503718 | A | | 2/2006 |
| JP | 2008106805 | A | | 5/2008 |
| JP | 2009028756 | A | | 2/2009 |
| JP | 2009066709 | A | | 4/2009 |
| JP | 2010184304 | A | | 8/2010 |
| JP | 2012091515 | A | * | 5/2012 |
| JP | 2012105647 | A | * | 6/2012 |
| WO | WO 2004037494 | A1 | * | 5/2004 |
| WO | 2007058189 | A1 | | 5/2007 |
| WO | WO 2010008328 | A1 | * | 1/2010 |
| WO | 2010115592 | A1 | | 10/2010 |
| WO | WO 2010115438 | A1 | * | 10/2010 |
| WO | WO 2010131999 | A1 | * | 11/2010 |

OTHER PUBLICATIONS

Chapter I International Preliminary Report on Patentability of PCT/SE2009/050518 filed May 11, 2009.

Non-final office action of co-pending U.S. Appl. No. 13/319,379 mailed May 9, 2014, all enclosed pages cited.

Non-final office action of co-pending U.S. Appl. No. 13/291,458 mailed May 8, 2014, all enclosed pages cited.

* cited by examiner

CHAINSAW ARRANGEMENT

CROSS REFERENCE TO RELATED APPLICATIONS

This application is a continuation of International Application PCT/SE2009/050518, filed May 11, 2009, the contents of which are incorporated herein in their entirety.

TECHNICAL FIELD

The present invention relates to a so called top handle chainsaw, which includes a guide bar, a cutting chain and a driving unit arranged to drive the cutting chain around the guide bar. The chainsaw further includes a handle section for carrying and operating the chainsaw, which handle section includes a control portion disposed on the upper side of the chainsaw. The control portion in turn includes a throttle lever for controlling the speed of the driving unit.

The terms 'front' and 'rear' are used to designate relative locations along a longitudinal axis of the chainsaw. The guide bar, for example, is located at the front end of the chainsaw, while the opposite end will be referred to as the rear end of the chainsaw, 'left' and 'right' are used to designate relative locations in relation to the longitudinal axis as if a user holds the chainsaw.

BACKGROUND ART

Top handle chainsaws are sometimes held and guided by the one hand holding the control portion while the operator only secures his hold with the other hand. Acting forces on the chainsaw produces tilt movements which must be compensated for by an appropriate effort of the hand holding the control portion in order to keep the chainsaw in a neutral position. This causes a considerable load on the wrist of the operator. U.S. Pat. No. 5,018,492 teaches a chainsaw provided with a housing portion arranged as a support for the heel of the hand which decreases the effort for holding the chainsaw in a neutral position despite tilt movements in a forward direction of the chainsaw. However, FIG. 1 of U.S. Pat. No. 5,018,492 shows that the part of the housing portion that functions as said support for the heel of the hand is a sharp edge, which is not very comfortable to the heel of the hand.

Furthermore, many users experience that the control portion of a top handle chainsaw does not provide for an ergonomic grip. Also, a problem has been that the control portion of the chainsaw rotates in the hand of the operator such that the operator has difficulty to hold the chainsaw in a desired inclined position. Also, many users experience that the wrist of the hand holding the control portion is often extensively bent while operating the chainsaw, which has proved to be unfavourable. Also, control portions of conventional top handle chainsaws do not fit various sizes of hands, and a bad fit may cause a worse control of the chainsaw and ergonomic disadvantages.

SUMMARY OF THE INVENTION

An object of the invention is to provide a control portion of a chainsaw that has ergonomic advantages and enables better control of the chainsaw.

This object is achieved by a chainsaw of the type mentioned in the first paragraph, wherein the guide bar defines a first longitudinal axis along the centre of the guide bar, as seen in a side view, and the control portion defines a second longitudinal axis substantially extending along an upper side of the control portion, also as seen in a side view. The angle, A, between the first- and the second longitudinal axes is between 14° and 45° and preferably between 14° and 35° and more preferably between 14° and 30°, all as seen in a side view. Thereby, the angle of the control portion relative to the guide bar is greater than for conventional top handle chainsaws, which means that the hand holding the control portion will not be as much bent downwardly as when operating said conventional chainsaws. This provides for a significant improvement to the ergonomics and less effort is required when operating the chainsaw. A control portion of the aforementioned design also provides for a better control of the chainsaw, which is very important especially as the top handle chainsaw is intended for e.g. professional arborists. The above advantages are present also for the angle A being in all other possible intervals in the range 14° to 45°, such as between 15° and 26°, or between 16° and 32°. Preferably, the interval is between 14° and 27°, or 14° and 24°, or 14° and 21° and even more preferably between 14° and 19°, or 14° and 17°, or 14° and 16°. In fact, the mentioned advantages are apparent for all possible intervals of the angle A within the range 14°-45° such as 14°-40°, 14°-38°, 14°-33°, 14°-23°, 15°-35°, 16°-35°, 17°-30°, 19°-30° and 20°-30°.

Preferably, a rear end of the control portion is connected to a housing portion at an outer surface part thereof, which defines a support surface for receiving the heel of the hand of the user, and which housing portion accommodates a carburettor or a battery therein. The support surface defines a plane, which plane forms an angle, B, with the second longitudinal axis, and B is between 105' and 145° and preferably between 110° and 140° and more preferably between 113° and 135°, all as seen in a side view. Thereby, the support surface is angled relative to the heel of the hand in a way to give a comfortable and ergonomic support to said heel of the hand, and this also provides better control of the chainsaw. This advantage has proved to be apparent for all possible intervals of the angle B within the range 105° and 145° such as 109°-141°, 112°-133°, 113°-129°, 115°-127°, 117°-125°, 119°-123°, 105°-125°, 115°-145°, 120-145° or 118°-130°.

Preferably, the left side of the control portion is provided with at least one left recess and alternatively at least two or three left recesses for receiving parts of the fingers of the user during operation of the chainsaw. Preferably, a front portion of the left side of the control portion is provided with one left recess for receiving a part of the thumb of the user during operation of the chainsaw. Preferably, the left side of the control portion is provided with an elongated recess for receiving at least one finger tip but preferably two finger tips and more preferably three or even four finger tips. Preferably, a front portion of the right side of the control portion is provided with at least one right recess for receiving parts of the fingers of the user during operation of the chainsaw. Alternatively, the front portion of the control portion has one right recess for receiving a part of the forefinger of the user during operation of the chainsaw. Preferably, at least a part of the right side of the control portion has a generally convex shape, as seen in an above view. Preferably, a part of the right side of the control portion has a generally convex shape, also as seen in an above view. The features mentioned in this paragraph all imply a better grip around the control portion and thus, the control portion is prevented from rotating in the hand of the operator. The latter of course implies a better control of the chainsaw and not much effort is needed in order to keep the chainsaw at a desired operating angle.

Another object of the invention is to provide a handle section of a chainsaw that provides possibilities to fit a larger group of users or to fit different types of conditions.

This object is also achieved by a chainsaw of the aforementioned type, wherein the handle section is composed of exchangeable part/s, which exchangeable part/s may be exchanged to part/s having other characteristics, which characteristics may include size, structure, material, form or colour. Thereby, the handle section has adjustable characteristics fitting a larger range of users and also fitting different conditions.

A further object of the invention is to provide a handle section of the aforementioned chainsaw that provides possibilities to adjust the characteristics of the control portion to fit e.g. differently sized hands of a large group of users.

This object is reached by a chainsaw, wherein the control portion has a left and a right side and the right side and/or the left side is/are at least partly composed of at least one first exchangeable part, which at least one first exchangeable part may differ in its dimensions from an at least one second exchangeable part, such that the width of at least a part of the control portion may be adjusted by exchanging the at least one first to the at least one second exchangeable part. Thereby, the control portion may fit differently sized hands of a large group of users.

Alternatively or additionally, the at least one first exchangeable part may differ in its characteristics from an at least one second exchangeable part, such that the surface structure of at least a part of the control portion may be adjusted by exchanging the at least one first to the at least one second exchangeable part. Thereby, a surface structure providing for a grip fulfilling the different needs of a larger group of users can be provided. Examples of such different structures may be ribs, grooves or recesses or other structures that provides increased friction or other desired properties to the control portion. Also, one exchangeable part may be exchanged to another part made of a different polymeric or preferably elastomeric material in order to provide for better grip conditions. Probably, different types of surface materials or structures are better adapted to various conditions such as cold, hot, wet or dry environments. Important when designing the surface of the control portion is that the control portion should not start rotating in the hand when the operator changes working position or working angle of the chainsaw. It is therefore beneficial having the possibility to exchange at least a part of the control portion to provide for a better grip for a certain user under certain conditions.

Preferably, at least a portion of the at least one exchangeable part is in contact with the hand of the user during operation of the chainsaw and at least a part of said portion of the at least one exchangeable part has a generally convex shape, as seen in an above view. Thereby, a better grip is provided when operating the chainsaw. The exchangeable parts may be more or less convex to fit to the hands of a large group of users. Alternatively or additionally, a part of said portion has a generally concave shape, which also provides for a better grip, especially when said portion is arranged for receiving a part of the fore finger of the hand holding the control portion.

Preferably, the at least one exchangeable part is one exchangeable part and forms a right side of the control portion, which control portion is a part of the handle section and includes a left and the right side and the exchangeable part is detachably connected to the left side of the control portion. Thereby, the right side of the control portion can easily be exchanged to another one with other characteristics, so as to fit different users and/or different conditions.

Preferably, the left side of the control portion is an integrated part with the handle section such that the left side of the control portion is not detachable. Thereby, it is sufficient to attach the right side of the control portion only to the left side of the control portion, which right side may be attached to the left side with a number of screws, such as two or three screws, or alternatively four, five or six. This way, the right side of the control portion is easily detached and exchanged by a dealer or by the user him/herself.

Preferably, the left side of the control portion holds the throttle lever and/or a safety button. Thereby, the exchangeable part of the right side of the control portion which preferably is the whole right side of the control portion, can be detached or exchanged without interfering with components such as the throttle lever and/or the safety button. This makes the detaching/exchanging much less complicated compared to having these components secured to both sides of the control portion. When having the throttle lever and/or the safety button secured to both sides, there is also a risk that the positions of the components will be disturbed when securing the right side to the left side, which might cause the components not to function very well.

Preferably, at least a portion of the exchangeable part/s is made of a polymeric material or more preferably an elastomeric material or even more preferably a TPE material. Thereby, such materials provide increased friction and therefore a better grip and control of the chainsaw. Such materials are also comfortable to the hand.

Other features of the invention are specified in the appended dependent claims, and what is achieved by these features will be disclosed below with support of the appended drawings.

DETAILED DESCRIPTION OF PREFERRED EMBODIMENTS

Figure 1:
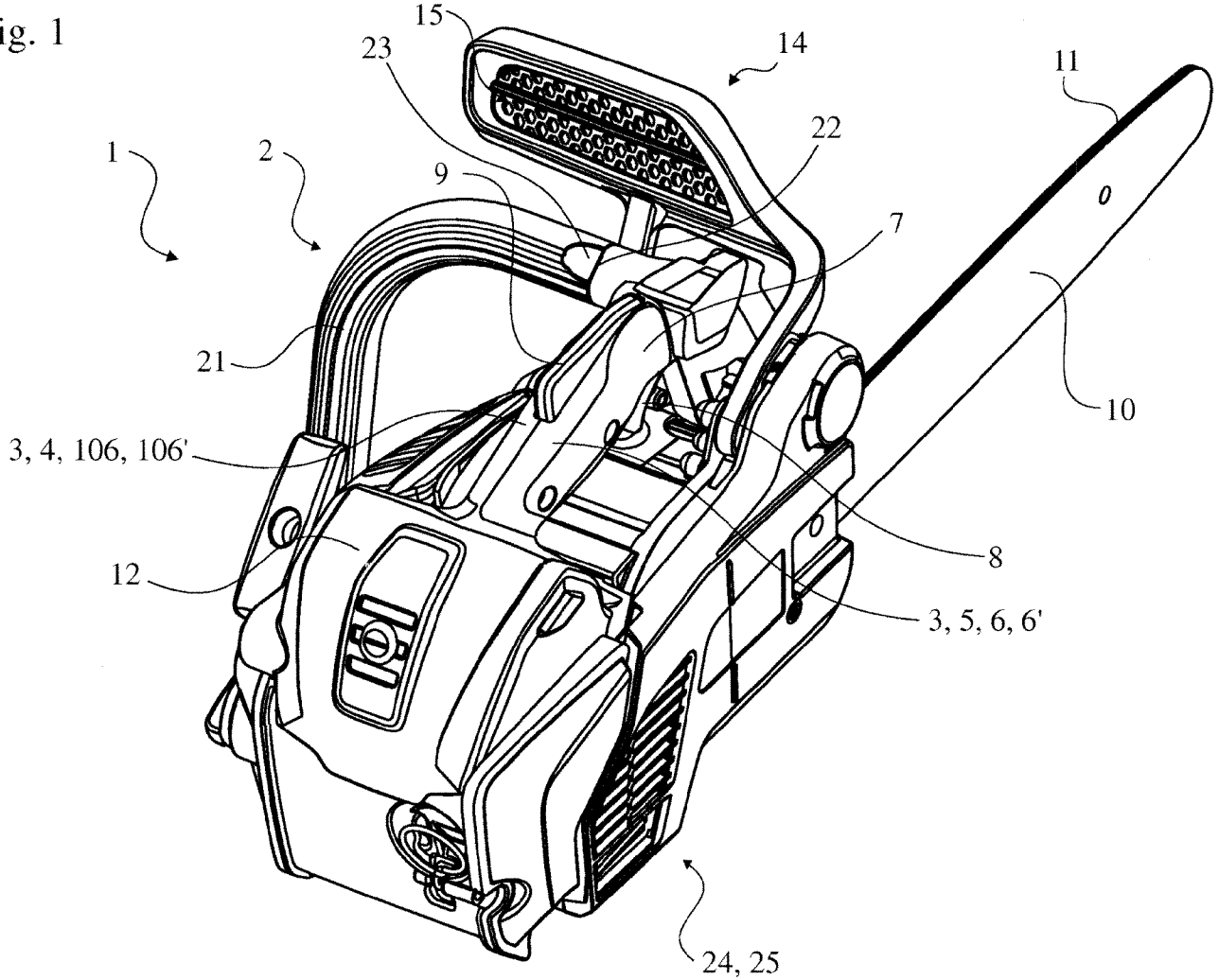
FIG. 1 is a perspective view of a top handle chainsaw.

FIG. 1 shows a perspective view of a top handle chainsaw 1 according to a preferred embodiment of the present invention. The chainsaw 1 includes a driving unit 25, which may include an internal combustion engine or an electric motor, for driving a cutting chain 11 around a guide bar 10. The chainsaw 1 is held and controlled, preferably with the right hand, by means of the control portion 3, which control portion 3 includes a left-4 and a right side 5, a throttle lever 8 on the under side for controlling the speed of the driving unit 25, preferably with the fore finger, and a safety button 9 on the upper side for preventing unintentional movement of the cutting chain 11. The control portion 3 is in turn a part of a handle section 2, which also includes a bail type hold portion 21, which extends on the left side of the chainsaw 1. The hold portion 21 is preferably held by the left hand and is mainly used for securing the hold of the control portion 3. The hold portion 21 may be held at various positions e.g. depending on how the chainsaw 1 is oriented when operating said chainsaw 1 and the position of the hold of the hold portion 21 may easily be changed by a sliding movement of the hand along the hold portion 1. The handle section 2 further includes a housing portion 12 which in the case of the driving unit 25 including an internal combustion engine preferably accommodates a carburettor and a fuel tank. In the case of an electric motor the housing portion 12 may accommodate a battery. The handle section 2 is devibrated in relation to a body part 24 of the chainsaw 1, which body part 24 includes the driving unit and to which body part 24 the guide bar 10 is connected. Devibration elements, such as e.g. coil springs are used on at least three positions between the handle section 2 and the body part 24 and the amount of vibrations experienced by the user holding the handle section 2 is far less compared to having no devibration. A hand guard 14 projects in front of the handle section 2, which hand guard 14 is arranged to actuate a brake to brake the movement of the cutting chain 11 when the hand guard 14 is pivoted e.g. from a kick-back. The hand guard 14 is made of a polymeric material and includes a see-through protective structure 15. The protective structure 15 is see-through as it is provided with holes. In the preferred embodiment the holes have a so called honey comb shape, which means they are provided with six edges.

Figure 2:
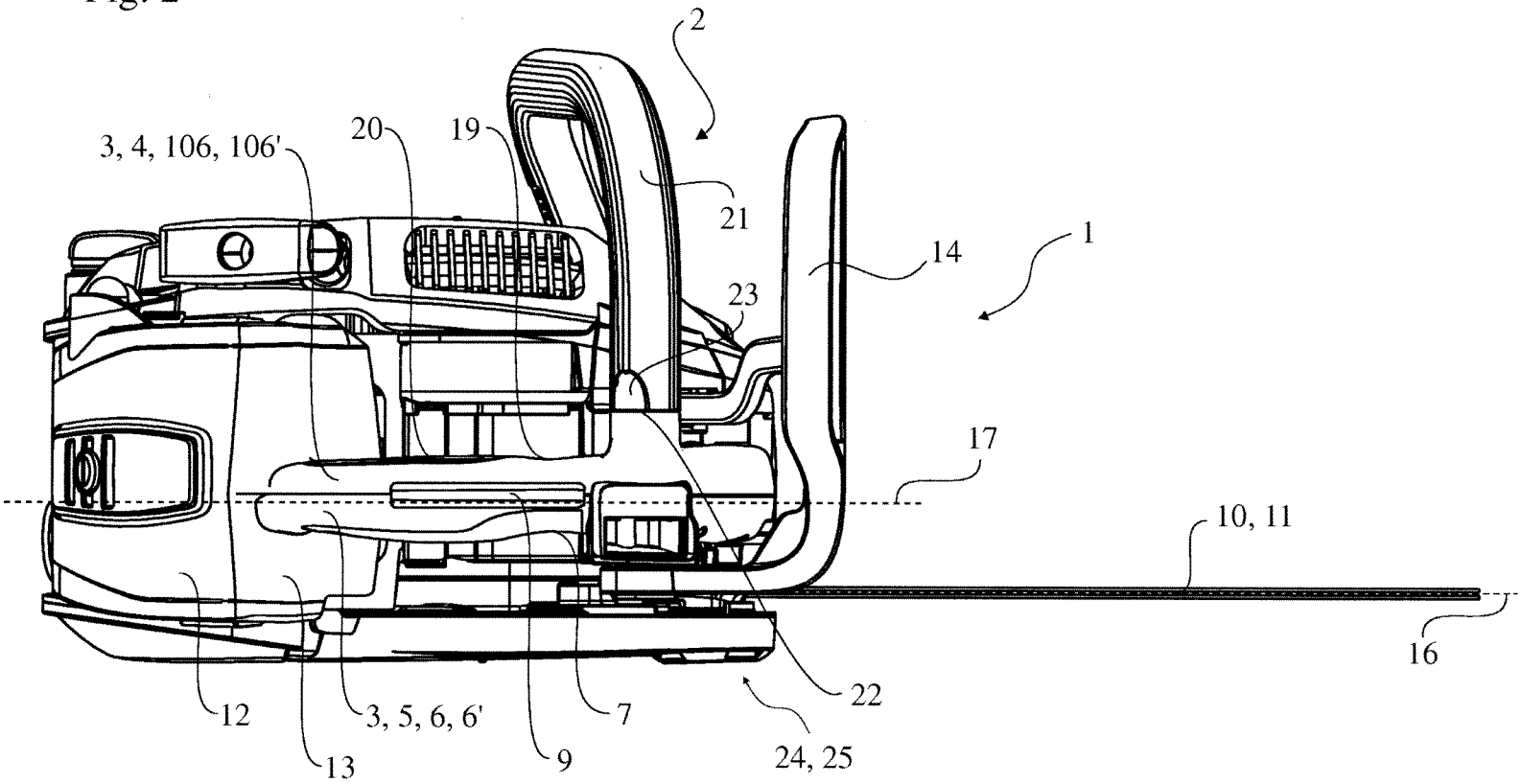
FIG. 2 is an above view of the top handle chainsaw.

FIG. 2 shows the chainsaw 1 according to the preferred embodiment from an above view. The left side of the control portion 3 is forming one unit with the housing portion 12 and the right side 4 of the control portion 3 is connected to said left side 5 of the control portion 3. The left side 4 is preferably provided with a front recess 19 intended for gripping with the thumb of the hand holding the control portion 3. There is also a recess 23 which will be referred to as the thumb support surface part 23 in front of said front recess 19 at a position where the left side 4 of the control portion 3 protrudes to the left and meets a first end 22 of the hold portion 21. The thumb support surface part 23 could be disposed on an upper side of either the control portion 3 or the hold portion 2 and serves as an alternative support for the thumb of the hand holding the control portion 3. The thumb support surface part 23 has proved beneficial when applying pressure between the cutting chain 11 and the object being cut, other than that pressure caused by the weight of the chainsaw 1. This is especially advantageous when the orientation of the chainsaw 1 differs from an up right position, which implies that there is not much or no help from the weight of the chainsaw 1 when applying pressure. Using the thumb support surface part 23 as a support for the thumb is e.g. less exhausting and probably it may also increase the accuracy of the cut. The left side of the control portion 3 is also provided with an elongated recess 20, substantially elongated along a longitudinal axis of the control portion 3. The elongated recess 20 is intended for receiving the finger tips of the little finger, the ring finger and the middle finger of the hand holding the control portion 3, but this may vary depending on the size of the hand of the user. The elongated recess 20 has proved beneficial for providing a good grip of the control portion 3 and preventing the control portion 3 to start rotating in the hand of the user. Also, the elongated recess 20 provides for a good grip for various sizes of hands.

Figure 3:
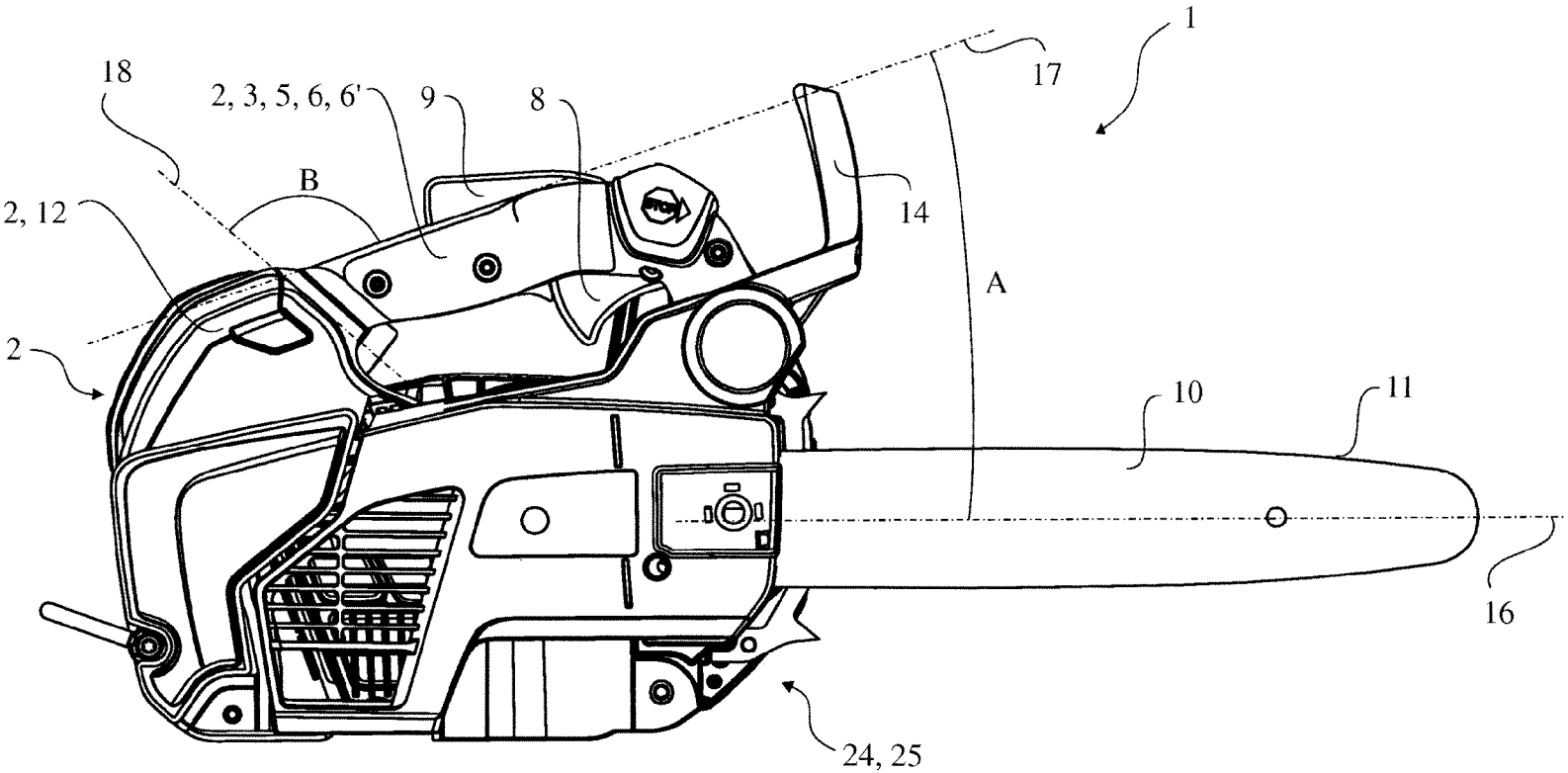
FIG. 3 is a right side view of the top handle chainsaw.

FIG. 3 is a side view of the preferred embodiment of the invention and shows a first-longitudinal axis 16 and a second longitudinal axis 17. The first longitudinal axis 16 is defined as extending substantially along a centre of the guide bar 10 and the second longitudinal axis 17 substantially extends along an upper side of the control portion 3. The size of the angle, A, between the second-longitudinal axis 17 and the first longitudinal axis 16 has impact on how much the hand holding the control portion 3 will be bent during operation of the chainsaw 1. The angle, A, according to the preferred embodiment of the invention is about 15°, but may be up to about 45° and still be advantageous. For A greater than 45° the chainsaw 1 becomes high, and probably less versatile when operating in limited spaces. In some embodiments, the angle, A, may be between about 14° to about 45°. In other embodiments, the angle, A, may be between about 14° to about 35°, or about 14° to about 30°. In some other embodiments, the angle, A, may be between about 14° to about 27°, about 14° to about 24°, or about 14° to about 21°. In still other embodiments, the angle, A, may be between about 15° to about 21°, about 16° to about 20°, or about 17° to about 19°. In yet other embodiments, the angle, A, may be between about 14° to about 19°, about 14° to about 17°, or about 14° to about 16°.

An outer surface part 13 of the housing portion 12, which hereinafter will referred to as the support surface 13, is connected to a rear part of the control portion 3 and is a support for the heel of the hand when operating the chainsaw 1. The support surface 13 essentially defines a plane 18 that forms an angle, B, with the second longitudinal axis 17, which axis substantially extends along an upper side of the control portion 3, as seen in the side view. The angle B is about 121°, which has proved to provide for a good support for the heel of the hand holding the control portion 3. However, the advantages are present for B being in the range 105°-140°. In some embodiments, the angle, B, may be between about 105° to about 145°, about 110° to about 140°, or about 113° to about 135°. In other embodiments, the angle, B, may be between about 115° to about 130°, about 117° to about 127° or about 119° to about 123°. The support surface extends about 30 mm in a rightward direction from a rightmost rear end of the right side 5 of the control portion 3. In fact, the support surface may extend at least 24 mm, e.g. 35 mm, and still provide for a good support for the heel of the hand. In some embodiments, the support surface extends in a rightward direction at least 10 mm. The rightmost portion of the support surface 13 may also deviate from the plane 18 because of a bevelling of the housing portion 12.

Figure 4:
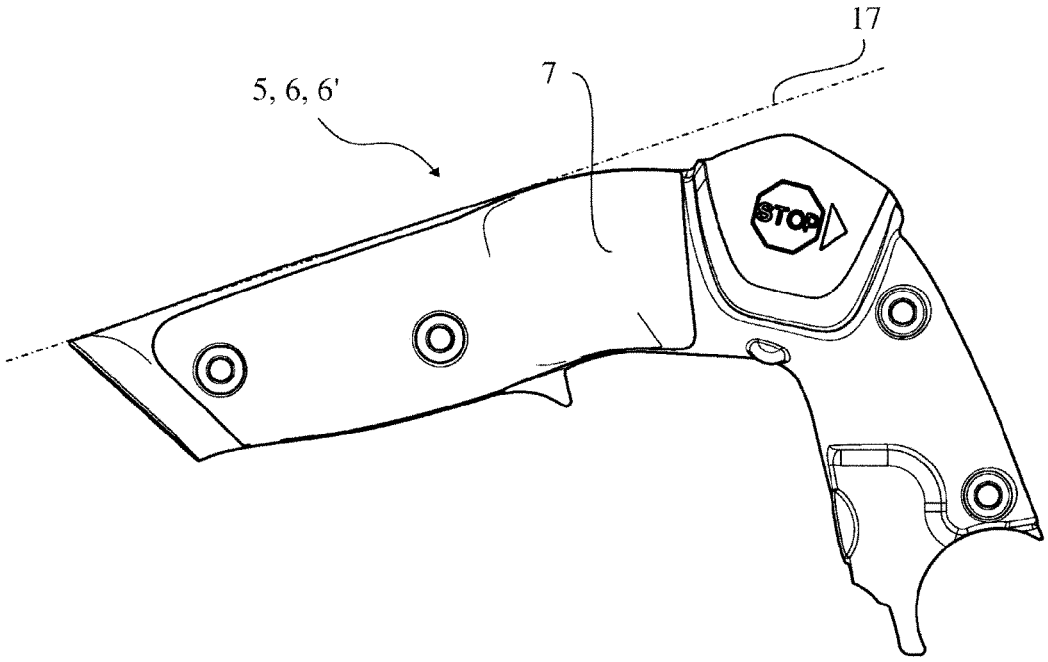
FIG. 4 is a right side view of an exchangeable part/a right side of a control portion.
Figure 5:
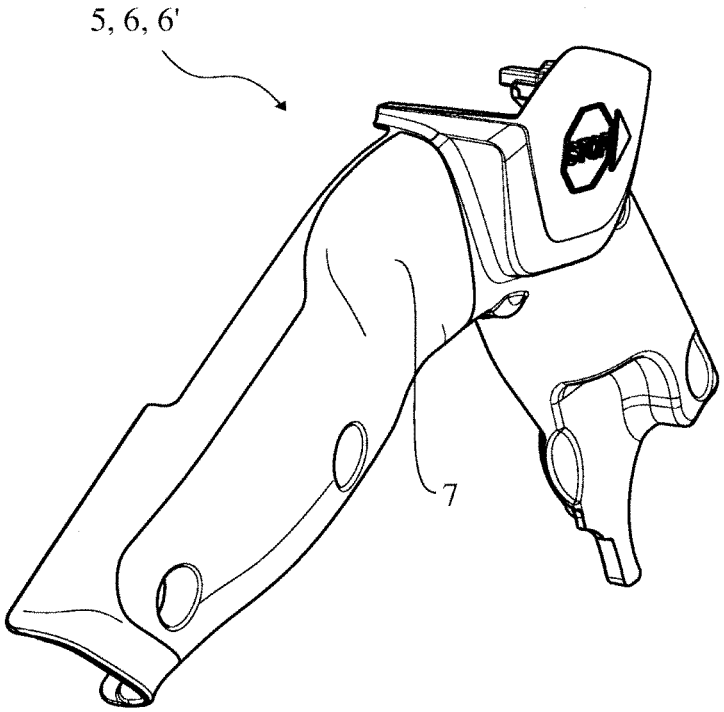
FIG. 5 is a perspective view of the exchangeable part/the right side of a control portion.

FIG. 4 is a side view of the exchangeable right side 5 of the control portion 3 and the same right side 5 is shown in FIG. 5 in a perspective view. The right side 5 may, in some cases, be embodied as the exchangeable part 6, 6' and may be exchanged to another exchangeable part 6, 6' with other characteristics. Of course the exchangeable part 6, 6' may be smaller and may just form a part of the right side 5 of the control portion 3. In an alternative embodiment of the invention at least a part of the left side 4 of the control portion 3 may be composed of at least one exchangeable part 106, 106'. In the preferred embodiment the right side 5 of the control portion 3 is secured to the left side 4 of the control portion 3 with four screws. The number of screws may of course vary, e.g. between one and six, such as three or five. Of course other attaching members would be possible for quick attachment/detachment of the exchangeable part 6, 6'. The throttle lever 8 and the safety button 9 are both only secured to the left side 4 of the control portion 3, and not to the right side 5, which provides for easy detaching or attaching of the exchangeable part 6, 6' without interfering with said throttle lever 8 or safety button 9. Also, this prevents the throttle lever 8 and the safety button 8 to become affected in a way to disturb their functions. Alternatively, only the throttle lever 8 is only secured to the left side 4. Preferably an exchangeable part 106, 106' on the left side 4 is of such a small size that it allows the throttle lever 8 and safety button 9 to be secured to a main portion of the left side 4.

Figure 6:
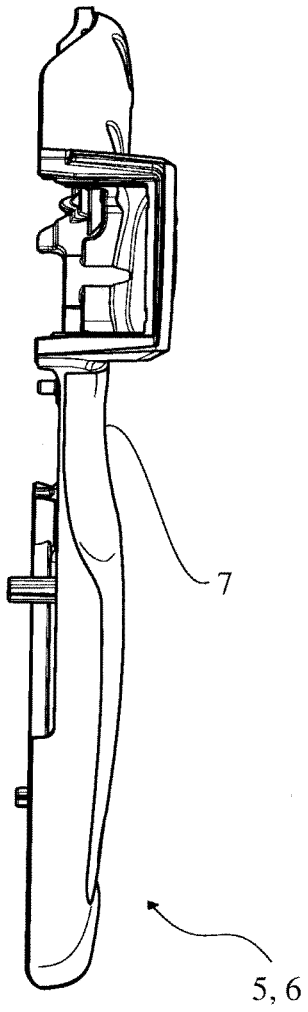
FIG. 6 is an above view of a first exchangeable part/the right side of a control portion.
Figure 7:
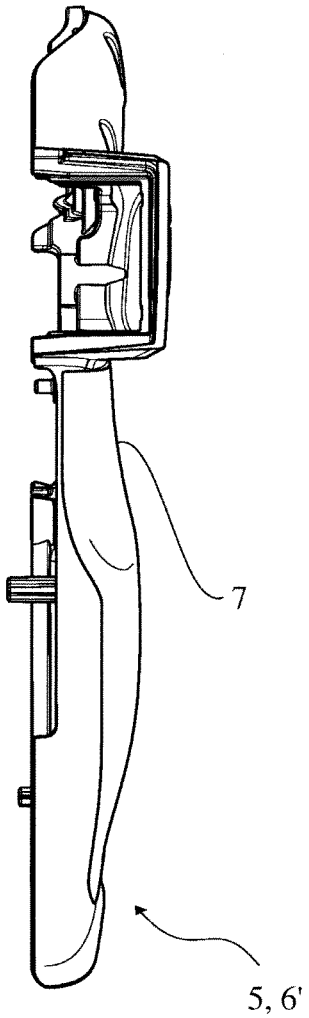
FIG. 7 is an above view of a second exchangeable part/the right side of a control portion.

FIGS. 6 and 7 are above views of two different exchangeable parts 6, 6' with different widths. We may call them a first-6 and a second exchangeable part 6'. The first exchangeable part 6 can easily be exchanged to the second 6' and vice versa to make the control portion 3 fit to a hand with different proportions. A range of differently sized exchangeable parts 6, 6' specified with sizes, such as small, medium, large and X-large, may be possible to choose from. Of course the exchangeable part/s 6, 6', 106, 106' can be provided with different surface structure to fit to the users needs. Examples of such surface structures may be grooves, ribs or recesses. The material of the part of the control portion 3 that is in contact with the hand is made of a TPE-material, but of course the choice of material may vary with different conditions, and another polymeric material may be preferable, such as another elastomeric material. The part of the exchangeable part 6, 6' that is in contact with the hand during operation has a substantially convex shape in order to fit better to the hand of the user, although the right recess 7 of the control portion 3 also provides for a smaller concave shape. This recess 7 is intended for receiving parts of the fore finger of the hand holding the control portion 3. The right recess 7 together with the left recess 19 on the left side 4 of the control portion 3 forms a part of the control portion 3 with less width. This provides for a better grip and a better control of the throttle lever 8.

The invention claimed is:

1. A modular chainsaw kit, comprising:

a chainsaw and a selected one of a first exchangeable part and a second exchangeable part, the chainsaw comprising:

a guide bar;

a cutting chain;

a driving unit arranged to drive the cutting chain around the guide bar; wherein the guide bar defines a first longitudinal axis extending along a centre of the guide bar; and a handle section for carrying and operating the chainsaw, wherein the handle section includes a control portion disposed on an upper side of the chainsaw, the control portion includes a throttle lever for controlling speed of the driving unit;

wherein the control portion defines a second longitudinal axis substantially extending along an upper side of at least a part of the control portion, wherein the control portion includes at least:

a first side forming one unit with a housing portion of the chainsaw, and a second side attachable to the first side on an opposite side of the handle section relative to the first side, the second side being configured to comprise the selected one of the first exchangeable part and the second exchangeable part, wherein the first and second exchangeable parts have different characteristics relative to each other, the different characteristics including size, structure, material, or form, so as to enable the handle section to provide adjustable characteristics fitting a large range of users based on which of the first exchangeable part or the second exchangeable part is installed with the first side.

2. A modular chainsaw kit according to claim 1, wherein the first side of the control portion holds the throttle lever, such that the first and second exchangeable parts are interchangeable on the second side of the control portion without interfering with said throttle lever.

3. A modular chainsaw kit according to claim 1, wherein the first exchangeable part or the second exchangeable part is made of a polymeric material.

4. A modular chainsaw kit according to claim 1, wherein an angle A between the first and the second longitudinal axes is between 14° and 45°.

5. A modular chainsaw kit according to claim 4, wherein A is between 14° and 20°.

6. A modular chainsaw kit according to claim 1, wherein a rear end of the control portion is connected to the housing portion at an outer surface part thereof, which defines a support surface for receiving a heel of a hand of a user.

7. A modular chainsaw kit according to claim 6, wherein the support surface defines a plane, and the plane forms an angle, B, with the second longitudinal axis, and B is between 105° and 145°.

8. A modular chainsaw kit according to claim 7, wherein B is between 115° and 130°.

9. A modular chainsaw kit according to claim 6, wherein the support surface extends in a rightward direction at least 10 mm in relation to a rightmost part of a rear end of a right side of the control portion.

10. A modular chainsaw kit according to claim 9, wherein the support surface extends in the rightward direction at least 24 mm.

11. A modular chainsaw kit according to claim 1, wherein the size characteristic is width and a width of the second side is adjustable by exchanging the first exchangeable part with the second exchangeable part having a width that is different than a width of the first exchangeable part.

12. A modular chainsaw kit according to claim 11, wherein the first exchangeable part is in contact with a hand of a user during operation of the chainsaw and the first exchangeable part has a generally convex shape.

13. A modular chainsaw kit according to claim 11, wherein the first exchangeable part is in contact with a hand of a user during operation of the chainsaw and the first exchangeable part has a generally concave shape.

14. A modular chainsaw kit according to claim 1, wherein the form characteristic is surface structure, and a surface structure of the second side is adjustable by exchanging the first exchangeable part with the second exchangeable part having surface structure features that are different than surface structure features of the first exchangeable part.

* * * * *